US008205691B2

(12) United States Patent
Bowar et al.

(10) Patent No.: US 8,205,691 B2
(45) Date of Patent: Jun. 26, 2012

(54) DOWNHOLE VIBRATION DAMPENER

(75) Inventors: David A. Bowar, Casper, WY (US); Paris E. Blair, Casper, WY (US); Joseph L. Ficken, Casper, WY (US)

(73) Assignee: Hunting Energy Services (Drilling Tools), Inc., Houston, TX (US)

( * ) Notice: Subject to any disclaimer, the term of this patent is extended or adjusted under 35 U.S.C. 154(b) by 200 days.

(21) Appl. No.: 12/687,294

(22) Filed: Jan. 14, 2010

(65) Prior Publication Data

US 2010/0181111 A1 Jul. 22, 2010

Related U.S. Application Data

(60) Provisional application No. 61/145,863, filed on Jan. 20, 2009.

(51) Int. Cl.
*E21B 17/07* (2006.01)

(52) U.S. Cl. ..... 175/322; 175/321

(58) Field of Classification Search ..... 175/56, 175/321, 322

See application file for complete search history.

(56) References Cited

U.S. PATENT DOCUMENTS

| | | | | |
|---|---|---|---|---|
| 3,345,245 | A | 3/1967 | Hanusa | |
| 3,406,537 | A | 10/1968 | Falkner | |
| 3,660,990 | A | 5/1972 | Zerb et al. | |
| 4,133,516 | A * | 1/1979 | Jurgens | 267/125 |
| 4,139,994 | A | 2/1979 | Alther | |
| 4,162,619 | A | 7/1979 | Nixon, Jr. | |
| 4,211,290 | A | 7/1980 | Mason et al. | |
| 4,398,898 | A | 8/1983 | Odom | |
| 4,552,230 | A | 11/1985 | Anderson et al. | |
| 4,600,062 | A | 7/1986 | Teng | |
| 4,630,809 | A | 12/1986 | Duckworth | |
| 6,454,012 | B1 | 9/2002 | Reid | |

* cited by examiner

*Primary Examiner* — Brad Harcourt
(74) *Attorney, Agent, or Firm* — Charles D. Gunter, Jr.

(57) ABSTRACT

A down hole vibration dampener is disclosed that uses a set of polyurethane rings and steel support rings to create a shock absorber within the drill string to reduce the amount of vibration in the drill string. A splined mandrel extends longitudinally within a hollow cylindrical housing. A seal structure present between the exterior of the mandrel and the interior of the housing forms a lubricant receiving chamber. The series of polyurethane and steel rings are located in the lubricant chamber and are compressible longitudinally to absorb vibration and shock loads.

14 Claims, 4 Drawing Sheets

DOWNHOLE VIBRATION DAMPENER

CROSS-REFERENCE TO RELATED APPLICATIONS

This application claims priority from a previously filed provisional application Ser. No. 61/145,863, filed Jan. 20, 2009, entitled "Down Hole Vibration Dampener", by the same inventors.

BACKGROUND OF THE INVENTION

1. Field of the Invention

This invention relates to a tool positionable in a drill string or stem which is useful for absorbing shock, vibration and impact loading otherwise imparted to the drill string during drilling operations.

2. Description of the Prior Art

When a well is being drilled, the vibration caused by the drill bit is substantial. In some cases, the vibration frequency caused by the drilling can reach the harmonic frequency of the drill string, which causes the drill bit to begin bouncing off of the bottom of the hole. This condition is called slip-stick. This condition is completely undesirable, and is harmful to the drill bit and the other tools of the drill string. These tools include such equipment as the mud motor, the MWD Tools (Measurement While Drilling), and the LWD Tools (Logging While Drilling), just to mention a few. Slip-stick can also reduce penetration rates, which adds to the over all cost of drilling a borehole.

Because of the above noted problems, a number of prior art references exist which show various forms of vibration dampening and shock absorbing devices for incorporation into the drill string. By way of example, U.S. Pat. No. 4,162,619, issued Jul. 31, 1979, to Nixon et al., shows a shock sub for a well drilling string having a tubular housing adapted to be connected to one part of a drill string and a mandrel extending longitudinally into the housing and having an end portion adapted for connection to another part of the drill string. The mandrel and housing are shaped to define a non-circular annular cavity there between when assembled together. A compressible elastic metallic spring means is positioned in and substantially fills the non-circular annular cavity and is compressible longitudinally, radially and circumferentially to absorb longitudinal, radial and torsional vibration and impact loads and to transmit rotary movement between said housing and mandrel for imparting rotation from one part of the drill string to the other part connected by the drill sub. The spring means is preferably a knitted wire fabric or rope compressed into a compact mass capable of spring deflection in longitudinal, radial and circumferential directions relative to said shock sub assembly.

U.S. Pat. No. 4,211,290, issued Jul. 8, 1980, to Mason et al., shows a drill string tool having a low spring rate deformable element and a relatively long stroke. The deformable element comprises a stack of alternating non-deformable washers and deformable elastomer rings extending throughout the length of the element chamber. The element washers and rings are substantially out of contact with the side walls of the mandrel and barrel, so that each segment of the element experiences the total shock load. The spline and deformable element are in an oil bath. The annular space between mandrel and barrel is sealed at the upper end by a fixed seal and at the lower end by a floating seal.

The several forms of vibration dampeners and shock absorbers known in the prior art all suffer from one or more deficiencies.

The foregoing examples of the related art and limitations related therewith are intended to be illustrative and not exclusive. Other limitations of the related art will become apparent to those of skill in the art upon a reading of the specification and a study of the drawings.

SUMMARY OF THE INVENTION

The primary aspect of the present invention is to dampen vibrations caused by the act of drilling a well bore.

The following embodiments and aspects thereof are described and illustrated in conjunction with systems, tools, and methods which are meant to be exemplary and illustrative, not limiting in scope. In various embodiments, one or more of the above described problems have been reduced or eliminated, while other embodiments are directed to other improvements.

In accordance with the principles of the present invention, a down hole vibration dampener is disclosed that uses a set of polyurethane rings and specially designed steel support rings to create a shock absorber within the drill string to reduce the amount of vibration in the drill string and dampen the vibrations caused by drilling a well bore. The down hole vibration dampener of the invention includes a hollow cylindrical housing having an interior and an exterior and having a lower connecting extent for connection to one part of a drill string. A splined mandrel extends longitudinally into the interior of the cylindrical housing and has an upper connecting extent for connection to another part of a drill string. The splined mandrel also has a through bore for the passage of fluids. A seal structure is present in longitudinally spaced relation between the interior of the cylindrical housing and the splined mandrel and forms a liquid receiving chamber. A vibration dampening structure is located in the liquid receiving chamber, the vibration dampening structure being compressible longitudinally to absorb vibration and shock loads. The preferred vibration dampening structure is made up of a series of resilient rings formed of a polymeric material which are separated by a series of interspersed metal rings which give the resilient rings support and definition while being subjected to a load.

In a preferred embodiment of the invention, the resilient rings are formed of polyurethane and the metal rings are formed of steel. The polyurethane rings are shaped and engineered in such a manner that when the set of polyurethane rings are subjected to a shock load, the metal rings will not touch one another except under maximum load circumstances. As a result, the polyurethane rings and interspersed steel rings form a vibration dampening column, the column being encased on either of opposite ends thereof by metallic end rings. Preferably, the polyurethane rings each have an upper circumferential surface and a lower circumferential surface at least a selected one of which is provided with machined ridges which act as further shock absorbers and to improve the deformation properties of the polyurethane rings. The ridges which are present on the selected circumferential surface of the polyurethane rings are on the order of about 0.050 inch in height. The interspersed steel rings have chamfered outer edges in order that the edges not gouge the inner surface of the cylindrical outer housing nor gouge the outer surface of the spline mandrel.

In addition to the exemplary aspects and embodiments described above, further aspects and embodiments will become apparent by reference to the accompanying drawings forming a part of this specification wherein like reference characters designate corresponding parts in the several views.

DETAILED DESCRIPTION OF THE INVENTION

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

Parts, shown in the following drawings, toward the left of the drawings are referred to as down hole or forward parts as relating to the drilling direction. The back or up hole end of such parts is to the right.

Figure 1:
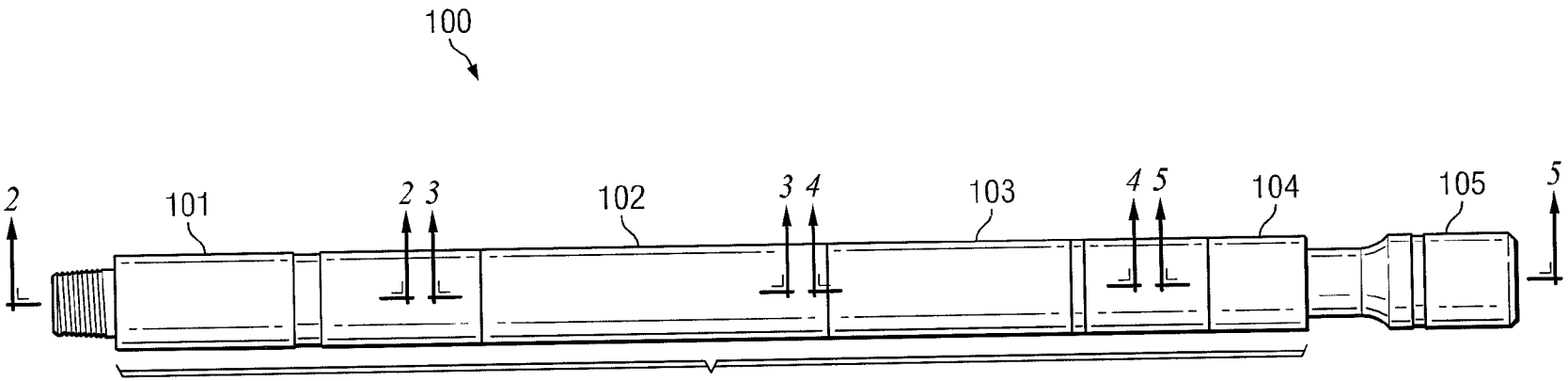
FIG. 1 is a longitudinal view of the vibration damper.

Referring first to FIG. 1, the vibration dampener 100 has a hollow generally cylindrical housing 200 made up of a bottom sub 101, a bowl 102, female hex housing 103, a seal carrier 104. The housing 200 is supported around a spline mandrel 105 and second mandrel 128. In the course of building a Bottom Hole Assembly, or the BHA, the bottom sub 101 of the vibration dampener 100 could be screwed into the top of a mud motor (not shown) and the top of the spline mandrel 105 of the vibration dampener 100 would then be screwed into the drill collars. Another BHA may have the vibration dampener farther up the hole and place it in the middle of the drill collars. In this case the vibration dampener 100 would be located several joints above the mud motor and both the down-hole and up hole ends of the vibration dampener would be screwed into the drill collars. The vibration dampener 100 has a through bore for flow with a center line show by dotted line C in FIGS. 2-5 and 7.

Figure 2:
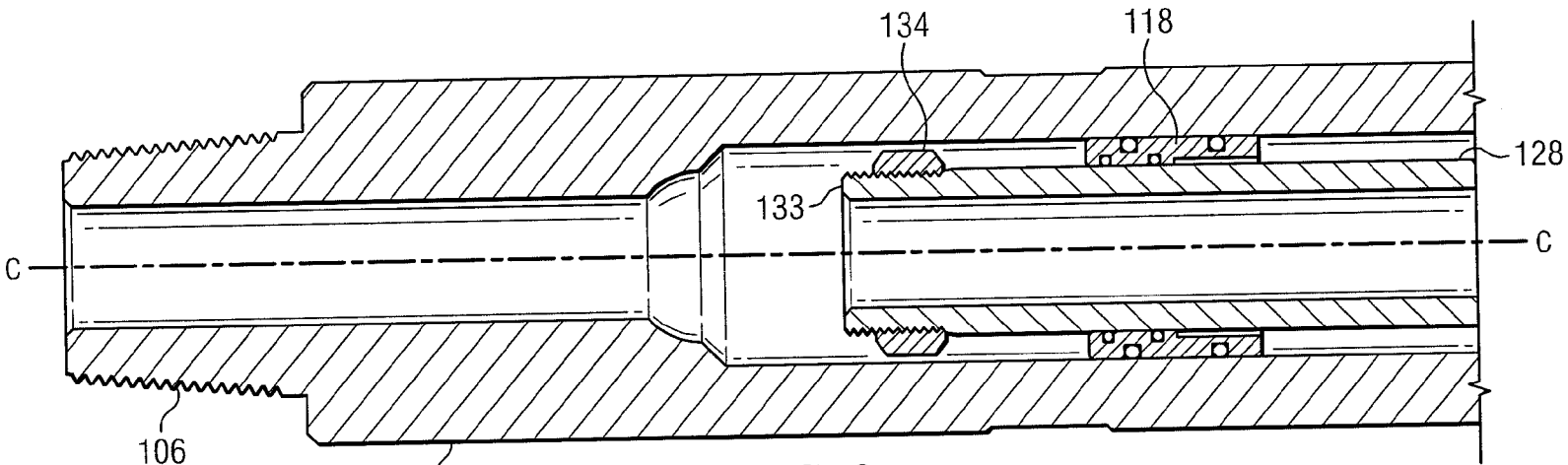
FIG. 2 is a cross section of FIG. 1 along line 2-2.
Figure 3:
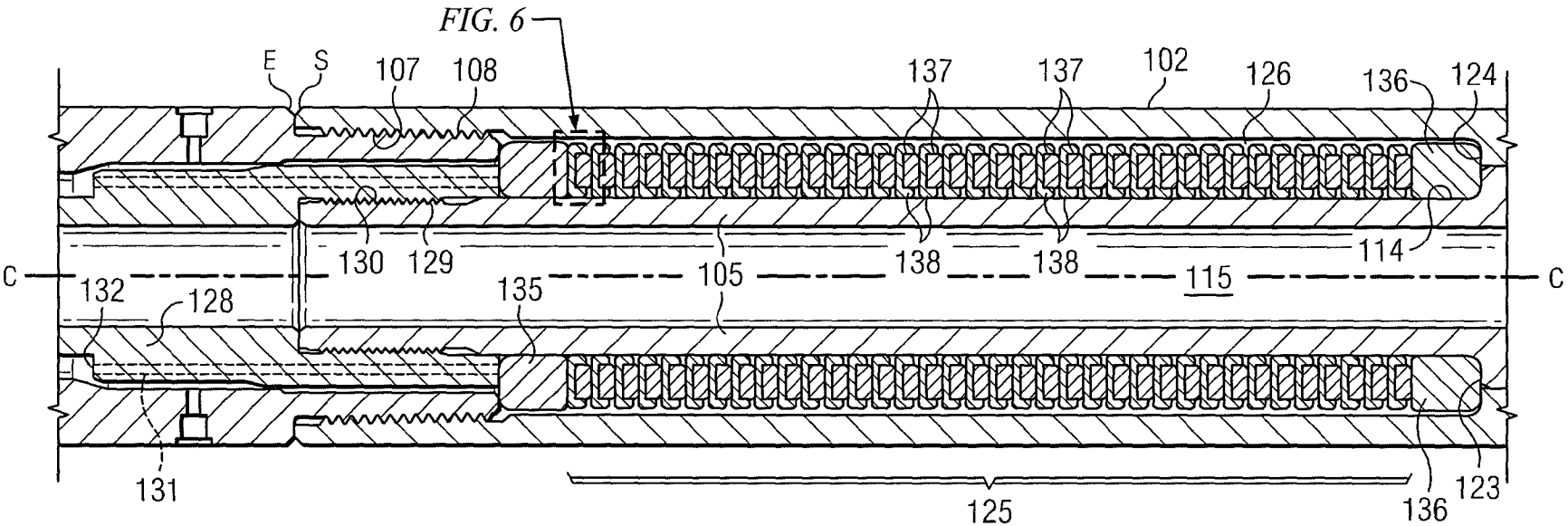
FIG. 3 is a cross section of FIG. 1 along line 3-3.
Figure 4:
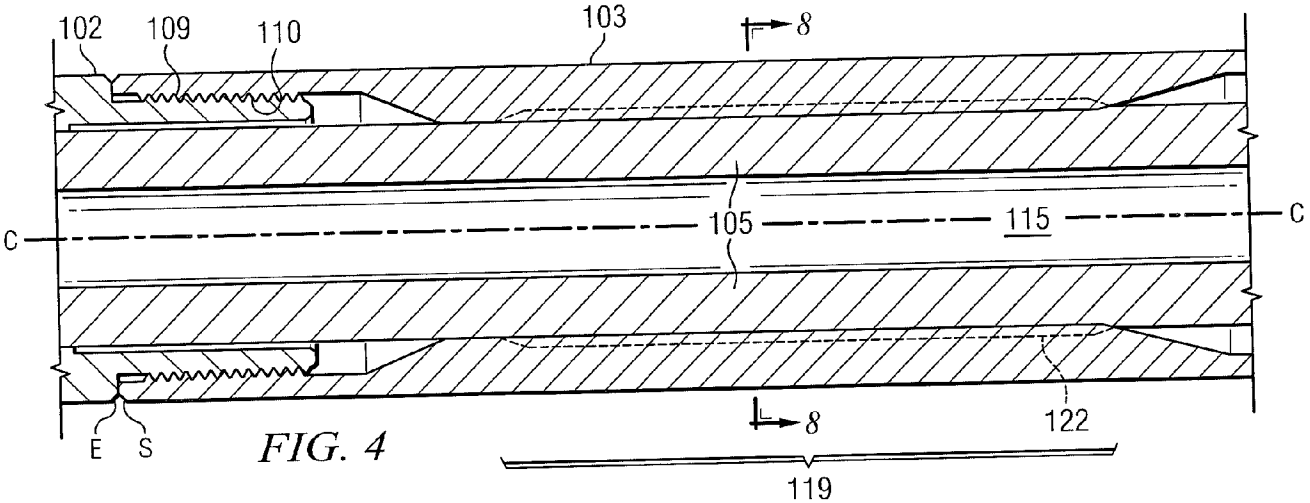
FIG. 4 is a cross section of FIG. 1 along line 4-4.
Figure 5:
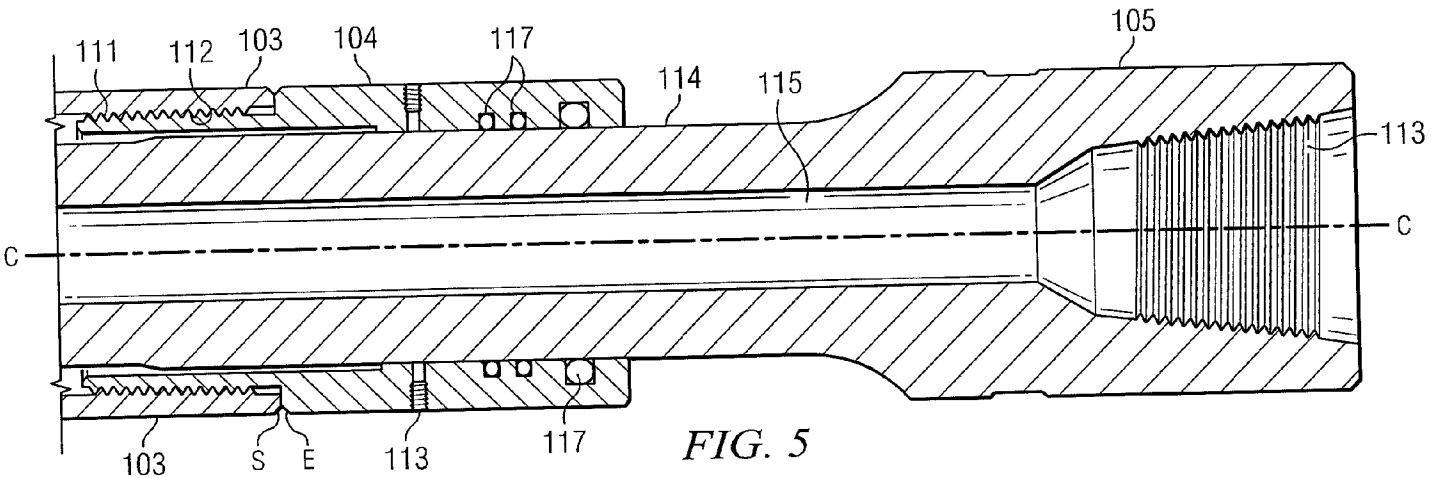
FIG. 5 is a cross section of FIG. 1 along line 5-5.

Referring next to FIGS. 2 and 3, the bottom sub 101 has two threaded male ends 106 on the down-hole end and 107 on the up hole end. The up hole end male thread 107 is attached to bowl 102 at down-hole threaded female end 108. The bowl 102, has threaded male end 109 at the up hole end, as seen in FIG. 4. The threaded male end 109 of bowl 102 attaches to the female hex housing 103 at the female threads 110. The female hex housing 103 has two female ends, down-hole end 110 and up hole end 111. The up hole end 111 female threads attaches to the seal carrier 104 at the down-hole male end 112, as seen in FIG. 5. At each of the threaded connections between the pieces of the housing 200 the male end has a circumferential shoulder E that the end S of the female threaded connection rests against, as seen in FIGS., 3, 4 and 5. These connections allow the housing 200 to act as a single piece with regard to weight transfer of the drilling string.

The spline mandrel 105 is supported within the housings 102, 103, and 104, and extends from the bowl 102 through the female hex housing 103 to the seal carrier 104 and extends beyond the seal carrier 104, as seen in FIG. 5. The spline mandrel 105 has an outer surface 114 and an inner bore 115. The seal carrier 104 has seals (not shown) in grooves 117. Seals are standard seals used for mud motors and similar devices, known in the art and therefore not further described. Threaded hole 113 is a fill port to fill the entire body of the tool with oil to act as a lubricant and shock absorber. The seals at the seal carrier 104 forms one end of a sealed chamber and the piston 118 (FIG. 2) is the other end. The seal carrier 104 functions to form a sealed area on the inside of the vibration damper 100 from the seal carrier 104 to the piston 118, seen in FIG. 2. The floating movable piston 118 is capable of moving up hole or down hole to compensate for the expansion and contraction of the oil placed inside.

Figure 8:
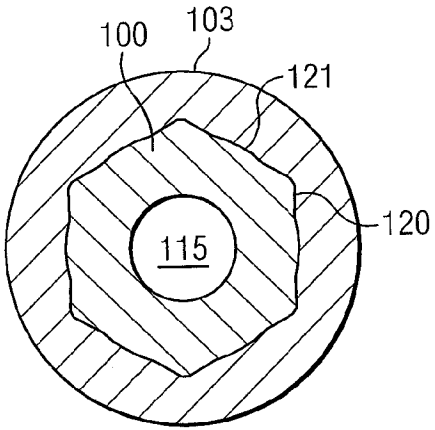
FIG. 8 is a cross section along line 8-8 of FIG. 4.
Figure 7:
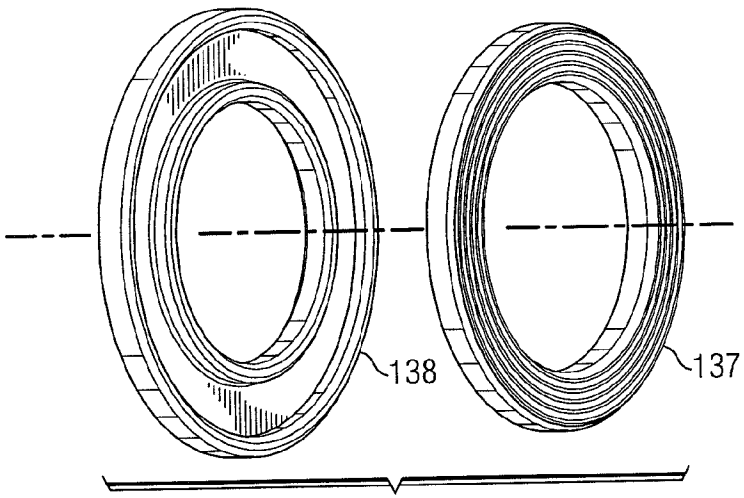
FIG. 7 is an exploded view of a single set of metal and polymeric rings.

The spline mandrel 105 extends through the female hex housing 103. As see in FIG. 4, in the area 119 of the female hex housing 103 the spline mandrel 105 has a non-circular outer surface 120, which corresponds to the non-circular inner bore 121 of the female hex housing 103, as seen in FIG. 8, which functions to lock the spline mandrel 105 into engagement with the female hex housing 103, and thereby in to engagement with the housing 200 in torque only, but allows spline mandrel 105 to move axially within housing 103. In the disclosed embodiment the spline mandrel 105 has a hexagonal outer surface 120, in the area 119. In the other areas of the spline mandrel 105 the outer surface is generally circular. The hexagonal section of the spline mandrel transfers any torque applied to the spline mandrel 105 to the female hex housing 103 and then this torque is transferred via the threaded connection down to the bottom sub 101. This allows the torque to continue down hole to the bit, while at the same time it allows the inner part of the tool to move up and down hole relative to the outer housing 200 so that vibration is transferred to the polyurethane rings 137, as discussed below. The edges of the hexagon are shown in dotted lines 122 on FIG. 4. The outside of the female hex housing 103 has a portion surface that is undercut from the outer diameter, shown in the slight waviness of the surface in FIG. 4. This is an identification band where a user can stamp information about the tool such as a serial number. This undercut of the OD of the housing allows a person to stamp a number on the outside surface but keep it under the original OD so that it is not so easily worn off.

Figure 6:
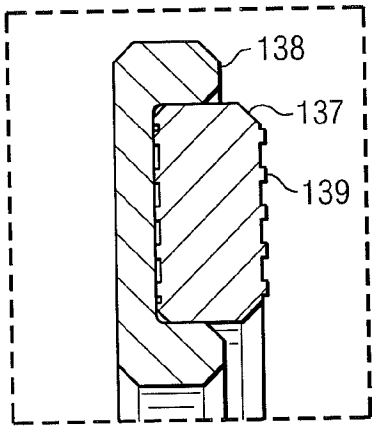
FIG. 6 is as detail view of a portion of FIG. 3.

The spline mandrel 105 extends from the female hex housing 103 down to the bowl 102 in FIG. 3. The outer surface of the spline mandrel 105 has a shoulder 123, which in the relaxed position of the tool, lines up directly across from the shoulder 124 of the bowl 102 forming a space 125 between the inner surface 126 of the bowl 102 and the outer surface 114 of the spline mandrel 105. Space 125 extends for a substantial portion of the length of bowl 102. This space 125 is taken up with a saplurative number of polyurethane rings 137 incased by steel rings 138. In the depicted embodiment there are 36 rings of each type. More or less could be used depending on the application. The steel rings 138 give the polyurethane rings 137 support and definition while being subjected to a load. The polyurethane rings 137 are shaped and engineered in such a manner that when the set of rings are subjected to a shock load, the steel rings 138 will not touch one another except under the maximum load circumstances. Therefore just the polyurethane rings 137 bear the vibrations or shock loads and not the steel rings 138. The ridges 139 as found in FIG. 6 are 0.050 inches high in the depicted embodiment and act as further shock absorbers and to improve the deformation properties of the rings 137. This height of about 0.050 of an inch has been determined to be at the most desirable height in terms of function, any shorter and these ridges did not deform as desired and any taller these ridges tended to bend over instead of squishing flat in the desired configuration. In the depicted embodiment there are 5 ridges, however, other numbers of ridges could be used as well, depending on the application. The edges of steel rings 138 (see in FIG. 6) are chamfered in order that the sharp edges do not gouge into the inner surface 126 of the bowl housing 102 nor gouge into the outer surface 114 of the spline mandrel 105, which would impair there functionality or ability to slide along these surfaces without restrictions.

The down-hole end of the spline mandrel 105 is a male thread 129 which is screwed into the female threaded end 130 of the second mandrel 128 in FIG. 3. The second mandrel 128 has holes 131, shown in dotted lines, extending from threaded female end 130 to shoulder 132. The down hole end 133 of second mandrel 128 bears piston 118 and piston nut 134.

End rings 135, 136 are placed at each end of space 125. The down hole end ring 135 abuts against both the female threaded end 130 of the second mandrel 128 and the male threaded end 107 of the bottom sub 101. The up hole end ring 136 abuts against the shoulder 124 of the bowl 102 and the shoulder 123 of the spline mandrel 105. This allows the transfer of force from the drill string to the shock absorber portion of the invention . . . ie the polyurethane rings. This also limits the amount of movement the inner and outer sections can have in the down hole/up hole directions relative to each other. They can only move until maximum compression of the polyurethane rings 137 is reached, and the polyurethane rings no longer posses the ability to act as a shock absorber or vibration dampener due to the fact that the elastic point for the polyurethane rings 137 has been exceeded, thus the total compression forces are now so large that the steel rings 138 are now against each other.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

In general the terms and phrases used herein have their art-recognized meaning, which can be found by reference to standard texts, journal references and contexts known to those skilled in the art. The above definitions are provided to clarify their specific use in the context of the invention.

All patents and publications mentioned in the specification are indicative of the levels of skill of those skilled in the art to which the invention pertains. All references cited herein are hereby incorporated by reference to the extent that there is no inconsistency with the disclosure of this specification.

While the invention has been shown in only one of its forms, it is not thus limited but is susceptible to various changes and modifications without departing from the spirit thereof.

What is claimed is:

1. A down hole vibration dampener for dampening vibrations caused by drilling a well bore, the vibration dampener comprising:

a hollow cylindrical housing having a lower connecting extent for connection to one part of a drill string;

a splined mandrel extending longitudinally into the cylindrical housing and having an upper connecting extent for connection to another part of a drill string, the splined mandrel having a through bore;

an upper seal structure located between the splined mandrel and an interior of the cylindrical housing adjacent the upper extent thereof;

a floating, movable piston located between the splined mandrel and the interior of the cylindrical housing adjacent a lower extent thereof which, together with the upper seal structure defines a lubricant chamber for the vibration dampener;

a vibration dampening structure located in the lubricant chamber which is formed between the interior of the hollow cylindrical housing and the splined mandrel, the vibration dampening structure being compressible longitudinally to absorb vibration and shock loads;

wherein the vibration dampening structure is made up of a series of resilient rings formed of a polymeric material which are separated by a series of interspersed metal rings which give the resilient rings support and definition while being subjected to a load;

wherein the resilient rings are formed of polyurethane;

wherein the metal rings are formed of steel; and wherein the polyurethane rings are shaped and engineered in such a manner that when the set of polyurethane rings are subjected to a shock load, the metal rings will not touch one another except under maximum load circumstances.

2. The down hole vibration dampener of claim 1, wherein the polyurethane rings and interspersed steel rings form a vibration dampening column, the column being encased on either of opposite ends thereof by metallic end rings.

3. The down hole vibration dampener of claim 2, wherein the polyurethane rings each have an upper circumferential surface and a lower circumferential surface at least a selected one of which is provided with machined ridges which act as further shock absorbers and to improve the deformation properties of the polyurethane rings.

4. The down hole vibration dampener of claim 3, wherein the ridges which are present on the selected circumferential surface of the polyurethane rings are on the order of about 0.050 inch in height.

5. The down hole vibration dampener of claim 4, wherein the interspersed steel rings have chamfered outer edges in order that the edges not gouge the inner surface of the cylindrical outer housing nor gouge the outer surface of the spline mandrel.

6. A down hole vibration dampener for dampening vibrations caused by drilling a well bore, the vibration dampener comprising:

a hollow cylindrical housing having a lower connecting extent for connection to one part of a drill string;

a splined mandrel extending longitudinally into the cylindrical housing and having an upper connecting extent for connection to another part of a drill string, the splined mandrel having a through bore;

a second mandrel section connected to and depending downwardly from the splined mandrel;

an upper seal structure located between the splined mandrel and an interior of the cylindrical housing adjacent the upper extent thereof;

a floating, movable piston located between the second mandrel section and the interior of the cylindrical housing adjacent a lower extent thereof which, together with the upper seal structure defines a lubricant chamber for the vibration dampener;

a vibration dampening structure located in the lubricant chamber which is formed between the interior of the hollow cylindrical housing and the splined mandrel, the vibration dampening structure being compressible longitudinally to absorb vibration and shock loads;

wherein the vibration dampening structure is made up of a series of resilient rings formed of a polymeric material which are separated by a series of interspersed metal rings which give the resilient rings support and definition while being subjected to a load and thereby form a vibration dampening column, the column being encased on either of upper and lower opposite ends thereof by metallic end rings; and wherein the upper end ring abuts against a shoulder present in the interior of the cylindrical housing and also a shoulder on the splined mandrel, and wherein the lower end ring abuts against an end of the second mandrel section, whereby force is transferred from the splined mandrel to the vibration dampening column while also limiting the amount of movement the splined mandrel and second mandrel section can have relative to the outer cylindrical housing.

7. The down hole vibration dampener tool of claim 6, wherein the amount of relative movement between the outer cylindrical housing and the splined mandrel is limited by the maximum compression of the polyurethane rings in the vibration dampening column.

8. The down hole vibration dampener of claim 7, wherein the resilient rings are formed of polyurethane.

9. The down hole vibration dampener of claim 8, wherein the metal rings are formed of steel.

10. The down hole vibration dampener of claim 9, wherein the polyurethane rings are shaped and engineered in such a manner that when the set of polyurethane rings are subjected to a shock load, the metal rings will not touch one another except under maximum load circumstances.

11. The down hole vibration dampener of claim 10, wherein the polyurethane rings and interspersed steel rings form a vibration dampening column, the column being encased on either of opposite ends thereof by metallic end rings.

12. The down hole vibration dampener of claim 11, wherein the polyurethane rings each have an upper circumferential surface and a lower circumferential surface at least a selected one of which is provided with machined ridges which act as further shock absorbers and to improve the deformation properties of the polyurethane rings.

13. The down hole vibration dampener of claim 12, wherein the ridges which are present on the selected circumferential surface of the polyurethane rings are on the order of about 0.050 inch in height.

14. The down hole vibration dampener of claim 13, wherein the interspersed steel rings have chamfered outer edges in order that the edges not gouge the inner surface of the cylindrical outer housing nor gouge the outer surface of the spline mandrel.

* * * * *